US011825952B2

(12) United States Patent
Pennington

(10) Patent No.: US 11,825,952 B2
(45) **Date of Patent: *Nov. 28, 2023**

(54) VENTILATED COMFORT LAYER

(71) Applicant: Diamond Mattress Company, Inc., Compton, CA (US)

(72) Inventor: Shaun Pennington, Compton, CA (US)

(73) Assignee: Diamond Mattress Company, Inc., Compton, CA (US)

( * ) Notice: Subject to any disclaimer, the term of this patent is extended or adjusted under 35 U.S.C. 154(b) by 287 days.

This patent is subject to a terminal disclaimer.

(21) Appl. No.: 17/301,255

(22) Filed: Mar. 30, 2021

(65) Prior Publication Data

US 2021/0212475 A1 Jul. 15, 2021

Related U.S. Application Data

(63) Continuation of application No. 16/240,275, filed on Jan. 4, 2019, now Pat. No. 10,993,543.

(51) Int. Cl.

| | |
|---|---|
| ***A47C 21/04*** | (2006.01) |
| ***A47C 27/00*** | (2006.01) |
| ***A47C 27/14*** | (2006.01) |
| ***A47C 27/15*** | (2006.01) |
| ***A47C 23/04*** | (2006.01) |
| ***A47C 27/04*** | (2006.01) |
| ***A47C 27/12*** | (2006.01) |

(52) U.S. Cl.

CPC ..... *A47C 21/046* (2013.01); *A47C 21/04* (2013.01); *A47C 21/042* (2013.01); *A47C 23/04* (2013.01); *A47C 27/002* (2013.01); *A47C 27/04* (2013.01); *A47C 27/125* (2013.01); *A47C 27/142* (2013.01); *A47C 27/146* (2013.01); *A47C 27/15* (2013.01)

(58) Field of Classification Search

CPC ..... A47C 21/046; A47C 21/04; A47C 21/042; A47C 23/04; A47C 27/002; A47C 27/04; A47C 27/125; A47C 27/142; A47C 27/146; A47C 27/15; A47C 27/06; A47C 27/144

See application file for complete search history.

(56) References Cited

U.S. PATENT DOCUMENTS

| | | | |
|---|---|---|---|
| 2,012,042 | A | 8/1935 | Gerlofson et al. |
| 2,371,788 | A | 3/1945 | Weeber |

(Continued)

FOREIGN PATENT DOCUMENTS

| | | | |
|---|---|---|---|
| DE | 20105856 | U1 | 8/2001 |
| EP | 0606892 | A1 | 7/1994 |

(Continued)

*Primary Examiner* — Myles A Throop

(74) *Attorney, Agent, or Firm* — Brandon T. Cook; Gunn, Lee & Cave, P.C.

(57) ABSTRACT

A bed assembly includes a mattress that has rails that define an outer perimeter of the mattress and an inner core defined between the rails of the mattress. Springs are positioned within the inner core. A comfort layer including ventilation openings is supported by the rails of the mattress so that the comfort layer covers the mattress and the ventilation openings are in fluid communication with the inner core. In some instances, the comfort layer is positioned so that the ventilation openings are aligned with coil openings defined through the springs within the mattress.

1 Claim, 5 Drawing Sheets

(56) References Cited

U.S. PATENT DOCUMENTS

| | | | | |
|---|---|---|---|---|
| 3,222,697 | A | 12/1965 | Scheermesser | |
| 3,266,064 | A * | 8/1966 | Figman | A47C 21/044 5/641 |
| 4,673,605 | A | 6/1987 | Sias et al. | |
| 4,768,251 | A | 9/1988 | Baskent | |
| 4,901,387 | A | 2/1990 | Luke | |
| 5,388,296 | A | 2/1995 | Mansour | |
| 5,551,109 | A | 9/1996 | Tingley et al. | |
| 5,669,094 | A | 9/1997 | Swanson | |
| 6,052,853 | A * | 4/2000 | Schmid | A47D 15/001 5/93.1 |
| 6,199,234 | B1 * | 3/2001 | Srour | A47C 27/146 5/736 |
| 6,202,239 | B1 | 3/2001 | Ward et al. | |
| D446,071 | S | 8/2001 | Hawkins et al. | |
| 6,336,237 | B1 * | 1/2002 | Schmid | A47D 15/001 5/423 |
| 6,578,220 | B1 | 6/2003 | Smith | |
| 6,602,579 | B2 | 8/2003 | Landvik | |
| 6,866,915 | B2 | 3/2005 | Landvik | |
| 7,334,280 | B1 | 2/2008 | Swartzburg | |
| 9,211,017 | B2 | 12/2015 | Tyree | |
| 9,326,616 | B2 * | 5/2016 | DeFranks | A47C 21/048 |
| 10,993,543 | B2 * | 5/2021 | Pennington | A47C 27/06 |
| 2003/0150060 | A1 | 8/2003 | Huang | |
| 2004/0025258 | A1 * | 2/2004 | Van Der Wurf | A47C 27/144 5/718 |
| 2013/0081209 | A1 * | 4/2013 | Young | A47C 27/063 5/739 |
| 2013/0283538 | A1 * | 10/2013 | Young | A47C 27/20 5/724 |
| 2014/0033441 | A1 * | 2/2014 | Morgan | A47C 31/006 5/724 |
| 2015/0082550 | A1 * | 3/2015 | Hui | A47C 27/001 5/727 |
| 2015/0226278 | A1 * | 8/2015 | Voros | A47C 27/064 144/380 |
| 2017/0295945 | A1 | 10/2017 | Stickler | |
| 2020/0000241 | A1 * | 1/2020 | Jansen | A47C 31/001 |

FOREIGN PATENT DOCUMENTS

| | | | |
|---|---|---|---|
| EP | 0951850 | A1 | 10/1999 |
| EP | 1149547 | A1 | 10/2001 |
| EP | 1308112 | A1 | 5/2003 |
| GB | 2264050 | A | 8/1993 |
| GB | 2290959 | A | 1/1996 |
| JP | S55171262 | U1 | 12/1980 |
| WO | 2002021976 | A1 | 3/2002 |

* cited by examiner

VENTILATED COMFORT LAYER

REFERENCE TO RELATED APPLICATIONS

This application is a continuation of U.S. patent application Ser. No. 16/240,275, filed Jan. 4, 2019, which is hereby incorporated by reference.

BACKGROUND

Mattress comfort layers are placed on the surface of a mattress on which a person sleeps to provide a softer or more ergonomic surface than what is provided by the mattress. Typically, mattress comfort layers are made of foam or a memory foam to provide a more comfortable sleeping surface or are made from a quilted material filled with goose down or duck feathers. Although mattress comfort layers are designed to promote better sleep, a mattress comfort layer can collect heat and prevent a sleeper from staying cool during the night. Additionally, mattress comfort layers could harbor dust mites and other particles that could cause allergies.

Thus, there is a need for improvement in this field.

SUMMARY

It was discovered that traditional mattress topper designs have a number of significant drawbacks. For example, it was found that traditional mattress toppers failed to provide adequate ventilation. Moreover, these mattress toppers tend to shift during sleep, and their added bulk makes fitting and securing standard sheets difficult. The mattress described and illustrated herein addresses these as well as other issues by integrating a comfort layer having ventilation openings with an inner core made up of springs. In one embodiment, a bed assembly includes a mattress that has rails that form the outer perimeter of the mattress. An inner core is defined between the rails. One or more springs are positioned within the inner core of the mattress. Each of the springs includes a coil and a coil opening defined through the coil. A comfort layer is integrated into the mattress and forms at least one surface of the mattress. Ventilation openings extend through the comfort layer of a mattress so that air from the inner core of the mattress is able to escape to the exterior of the mattress (and vice-versa). The openings in the comfort layer extend entirely through the top and bottom sides of the ventilated comfort layer.

In some cases, the springs of the mattress may be positioned within the inner core of the mattress so that the core openings are aligned with the ventilation openings in the comfort layer, allowing air to flow through the coil openings of the springs. The air that flows through the coil opening is able to escape the mattress through an aligned ventilation opening in the comfort layer. By being directly secured to springs, the comfort layer generally does not shift during sleep, and common sheet sizes can be fitted onto the mattress.

Other variations of the mattress ventilation system include foam encased rails that make up the mattress edge and provide increased comfort. In some embodiments, the foam used to encase the rails is a polyurethane foam. A specific embodiment includes attaching the ventilated comfort layer to the foam encased rails. In another variation, a support layer may be integrated into a surface of the mattress opposite the comfort layer. The support layer can also be ventilated in a similar fashion as the comfort layer, such that both the top and bottom sides of the mattress are ventilated.

In one particular example, the ventilated comfort layer is directly attached to the rails of a regular spring unit with glue to form the system.

Further forms, objects, features, aspects, benefits, advantages, and embodiments of the present invention will become apparent from a detailed description and drawings provided herewith.

DESCRIPTION OF THE SELECTED EMBODIMENTS

Figure 1:
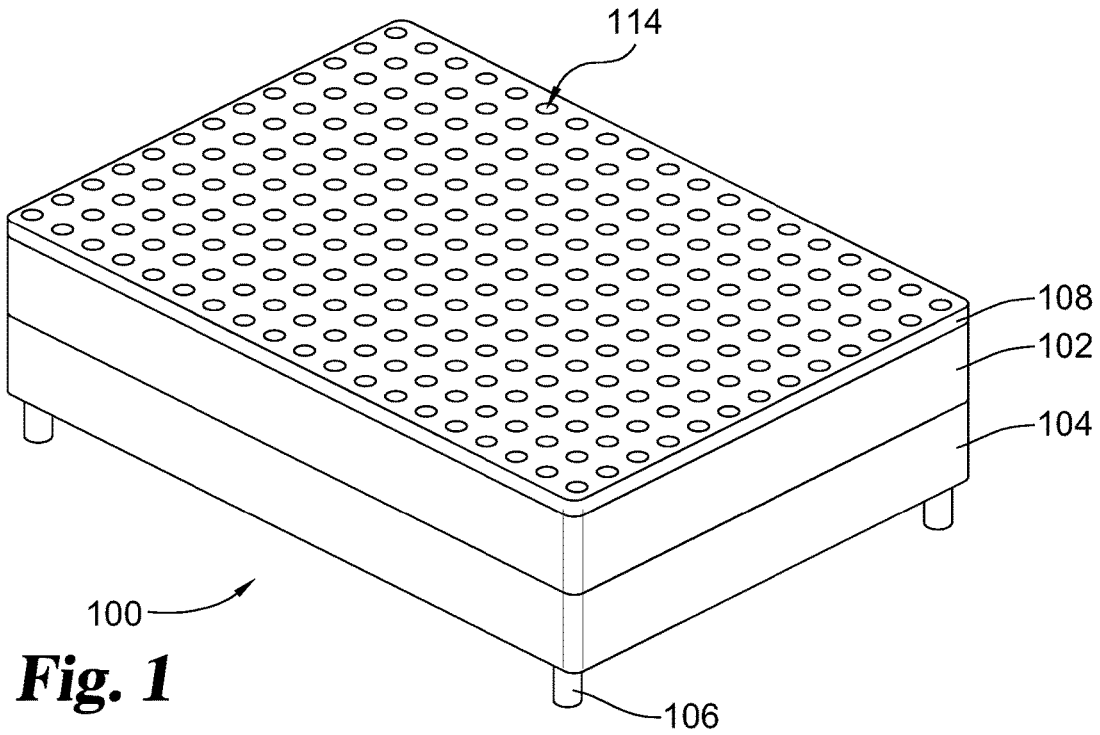
FIG. 1 is a perspective view of a bed assembly.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates. One embodiment of the invention is shown in great detail, although it will be apparent to those skilled in the relevant art that some features that are not relevant to the present invention may not be shown for the sake of clarity.

FIG. 1 shows a perspective view of a bed assembly 100 that forms a sleep system. As shown, the bed assembly 100 includes a mattress 102 that rests upon a foundation 104, and the foundation 104 rests on a frame 106. In the embodiment shown, the mattress 102 is rectangular, having a length that is greater than its width, and includes rounded corners. The mattress 102 includes a comfort layer 108 directly integrated into the structure of mattress 102, so that comfort layer 108 covers an inner core 110 (see FIG. 3) of the mattress 102. Comfort layer 108 typically forms the top surface of the mattress 102, or the surface of the mattress 102 on which a user lies while sleeping or while sitting on the mattress 102. The mattress 102, including the comfort layer 108 forms the mattress core or the mattress unit assembly. This mattress core forms the inside of the mattress 102 and is typically covered or surrounded by a covering, such as a ticking fabric (shown in FIG. 7).

Although the mattress 102 is shown with the foundation 104 and the frame 106, it should be understood that the foundation 104 and the frame 106 are shown for illustrative purposes only. Different shapes or styles of foundations or frames, other than what is illustrated, may be used to support the mattress 102. In some embodiments, the mattress 102 may be used without the foundation 104 and without the frame 106.

Comfort layer ventilation openings 114 are defined through comfort layer 108, allowing air to flow into and out of the inner core 110 of the mattress 102 through the ventilation openings 114. The increased air flow through inner core 110 allowed by ventilation openings 114 helps to regulate the temperature of mattress 102, allowing for cooler temperatures and more comfortable sleeping conditions. Integrating the comfort layer 108 with ventilation openings 114 directly into mattress 102 reduces the weight and cost of the mattress by removing an extra layer of material that would exist if the comfort layer 108 were a mattress topper separate from the mattress 102.

Figure 2:
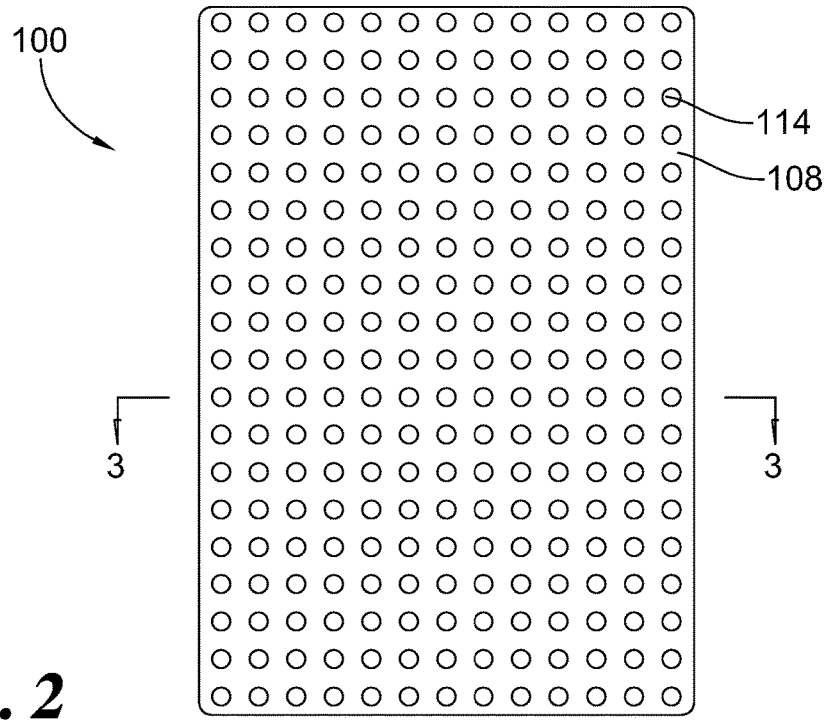
FIG. 2 is a top view of the bed assembly of FIG. 1.

A top view of the bed assembly 100 is shown in FIG. 2. As illustrated, the comfort layer 108 is attached to the mattress 102 so that the entirety of a sleeping surface of the mattress 102 is formed by the comfort layer 108. Since the comfort layer 108 is the surface on which a person using the bed assembly 100 sleeps, the comfort layer 108 is typically made of a material designed for comfort, such as foam, but may be made from any other suitable material. The embodiment illustrated in FIG. 2 shows the ventilation openings 114 covering substantially the entire surface of the comfort layer 108. However, in other embodiments, the ventilation openings 114 may be present only on a portion of the comfort layer 108. For example one half of the comfort layer 108 includes ventilation openings 114 while the other half of the comfort layer 108 includes no ventilation openings 114.

In FIG. 2, the ventilation openings 114 are arranged so that each ventilation opening 114 is evenly spaced on the comfort layer 108. However, in other embodiments, the ventilation openings 114 may be positioned in any desired arrangement. As an example, the spacing between the ventilation openings 114 may decrease in the center portion of the comfort layer 108 so that the density of ventilation openings 114 is greater in the center than along the edges of the comfort layer 108. Conversely, in another example, the spacing between the ventilation openings 114 may increase in the center portion of the comfort layer 108 so that the density of the ventilation openings 114 along the edges of the comfort layer 108 is greater than the density of the ventilation openings 114 in the center of the comfort layer 108. Any other suitable arrangement of the ventilation openings 114 may be used.

The ventilation openings 114 in FIG. 2 are circular. However, in other embodiments, the size and shape of the ventilation openings can be varied as desired. For example, the ventilation openings 114 may rectangular or triangular. Additionally, multiple shapes for the ventilation openings 114 can be used on the same comfort layer 108. As an example, a comfort layer 108 may include circular and rectangular ventilation openings, or any other desired combination of shapes. A single comfort layer 108 may also include ventilation openings 114 of varying sizes.

Figure 3:
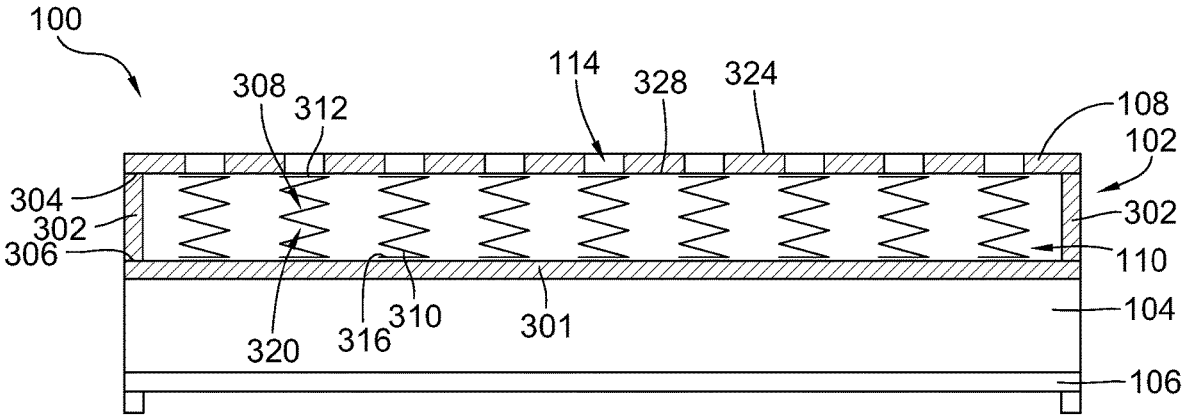
FIG. 3 is a cross-sectional side view of a mattress and a comfort layer of the bed assembly of FIG. 1.

A cross-sectional view of a portion of bed assembly 100 taken along line 3-3 is shown in FIG. 3. Mattress 102 includes a mattress support layer 301 and rails 302 that extend perpendicularly from the edges of the mattress support layer 301 to define an outer perimeter of the mattress 102. The mattress support layer 301 may form a solid base without ventilation openings or may include ventilation openings. Each rail 302 includes a rail sleeping surface 304 and a rail support surface 306 opposite the rail sleeping surface 304. The rails 302 are encased in a foam material, such as polyurethane, that provides support for mattress 102 while also providing a comfortable sleeping surface. In other embodiments, the rails 302 may be encased in any other suitable material or may have no casing.

As shown in FIG. 3, the comfort layer 108 is attached directly to the rails 302 at the rail sleeping surface 304. In some embodiments, the comfort layer 108 is attached to the rails 302 using glue or another form of adhesive capable of securing the comfort layer 108 to the rails 302. In other embodiments, the comfort layer 108 is attached to the rails 302 using stitching or any other suitable method of attachment to permanently attach the comfort layer 108 to the rails 302.

Figure 4:
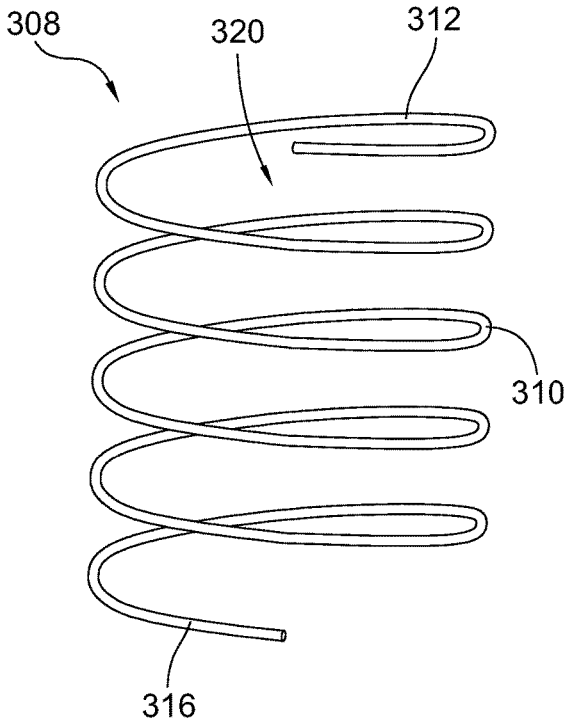
FIG. 4 is a perspective view of a spring from the mattress of FIG. 3.

The inner core 110 of the mattress 102 is defined between the rails 302. Springs 308 are arranged within the inner core 110 of the mattress 102. Each of the springs 308 includes a coil 310 that extends between a spring sleeping surface 312 and a spring support surface 316. The coil 310 is made from a resilient material, typically metal, but alternatively any other material that is sufficiently flexible. A coil opening 320 is defined in the interior of the coil 310 (see FIG. 4), extending from the spring sleeping surface 312 to the spring support surface 316.

The comfort layer 108 includes a comfort layer sleeping surface 324 and a comfort layer support surface 328 and a thickness defined between the comfort layer sleeping surface 324 and the comfort layer support surface 328. The ventilation openings 114 extend through the entirety of the thickness of the comfort layer 108, from the comfort layer sleeping surface 324 through the comfort layer support surface 328. The ventilation openings 114 are in fluid communication with the inner core 110 of the mattress 102, allowing air or other fluids from the inner core 110 to escape from the inner core 110 into the atmosphere surrounding the bed assembly 100 and allowing outside air to enter the inner core 110. In other embodiments, the ventilation openings may only extend through a portion of the comfort layer 108 while maintaining fluid communication with the inner core 110 of the mattress 102. As one example, a porous material, such as mesh covering, may surround comfort layer 108 so that the ventilation openings 114 are covered by the mesh covering. Despite being covered, the porous material still permits fluid communication between the ventilation opening 114 and the inner core 110.

In the embodiment shown, each of the ventilation openings 114 is aligned with a corresponding spring 308 so that ventilation opening 114 opens into the coil opening 320 defined through a corresponding spring 308. This alignment allows air and/or other fluids within the coil opening 320 to exit or enter through the corresponding ventilation opening 114. In different embodiments, the ventilation openings 114 are not aligned with a corresponding spring 308. In these embodiments, the ventilation openings 114 may be positioned between two springs or any other desired arrangement.

Figure 5:
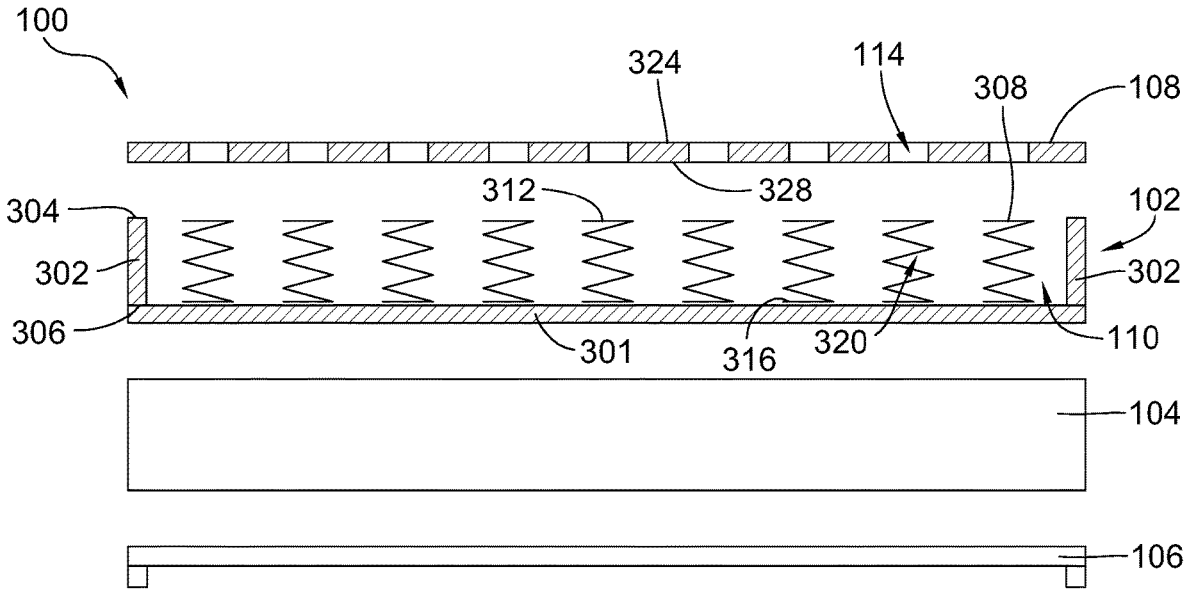
FIG. 5 is an exploded cross-sectional side view of the bed assembly of FIG. 1.

As shown in FIG. 3 and illustrated in the exploded view of the bed assembly 100 from FIG. 5, the comfort layer 108 is in direct contact with the springs 308. The comfort layer support surface 328 rests on the spring sleeping surface 312 of springs 308 located within the inner core 110 of the mattress 102. The height of the rails 302 is approximately equal to the height of the springs 308 so that the comfort layer 108 rests on both the rails 302 and the springs 308. In some embodiments, the springs 308 are attached to the comfort layer 108, for example by stitching the spring sleeping surface 312 into the comfort layer 108. In other embodiments, the comfort layer 108 rests on spring sleeping surface 312 without a direct attachment to the springs 308.

Figure 6:
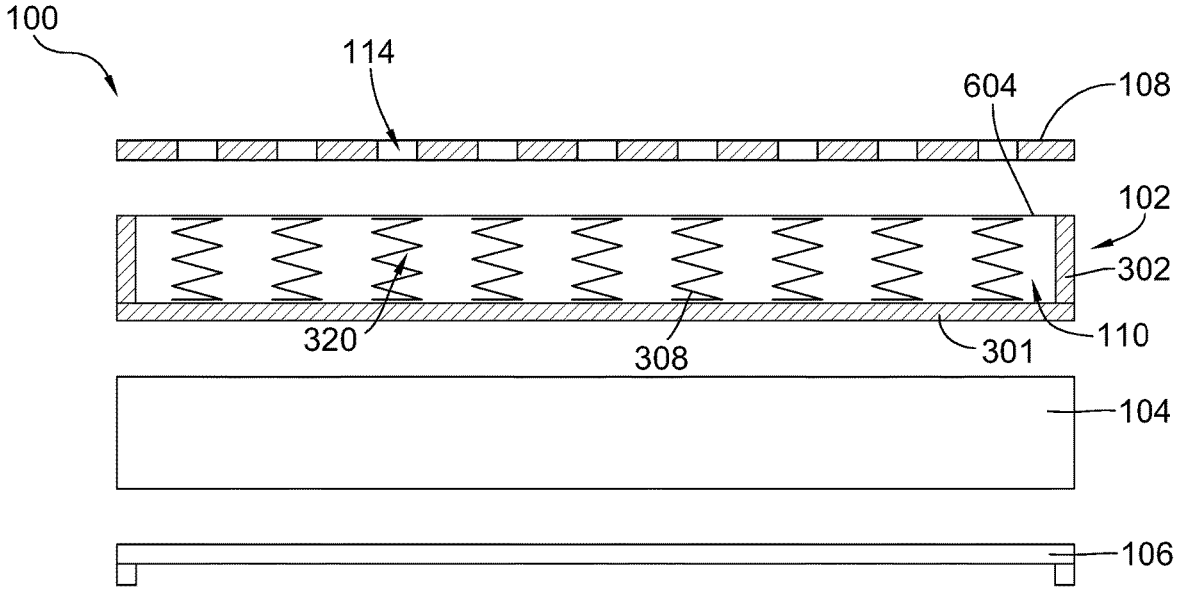
FIG. 6 is an exploded cross-sectional side view of an alternative embodiment of the bed assembly of FIG. 1.

In other embodiments, as shown in FIG. 6, the mattress 102 may include a mattress sleeping surface 604 that is separate from the comfort layer 108 and covers the springs 308. The comfort layer 108 is placed on top of the mattress sleeping surface so that the comfort layer support surface 328 contacts the mattress sleeping surface 604 rather than being in direct contact with the springs 308. The mattress sleeping surface 604 may include ventilation openings that correspond to the ventilation openings 114 of the comfort layer 108, or the mattress sleeping surface 604 may be made from a mesh material that allows air to escape from and/or enter into the inner core 110 of the mattress 102 through the ventilation openings 114. The comfort layer 108 may be removably attached to the mattress 102, for example, by using straps that the wrap around the mattress 102 or another suitable method of attachment. The comfort layer 108 may also be more permanently attached to the mattress 102, for example, by being connected to the mattress 102 by stitching.

Figure 7:
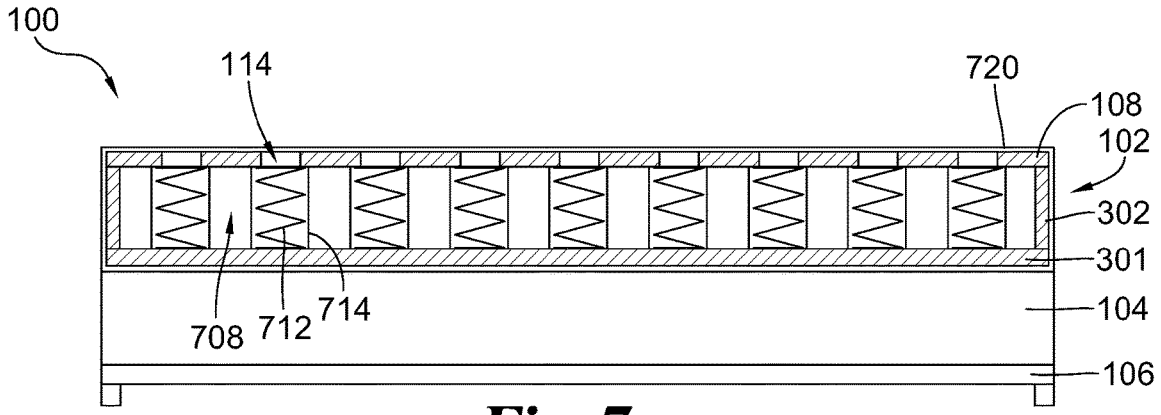
FIG. 7 is a cross-sectional side view of an alternative embodiment of the bed assembly of FIG. 1.

The springs 308 illustrated in FIG. 3 are open coil springs, forming an interconnected spring system. However, in an alternative embodiment, as illustrated in FIG. 7, the mattress 102 may include pocket springs 708, sometimes referred to as wrapped coils or Marshall coils. As should be recognized, the pocket spring includes a barrel shaped, knotless coil 712 that is individually enclosed in a fabric pocket 714. The wrapping material for the pocket 714 can be a fabric and/or another soft material that provides more comfort than the metal used to make the spring. The fabric pocket 714 of one pocket spring 708 can be attached to material of another fabric pocket 714 to connect the springs 708 together. The attachment of each pocket spring 708 can be made by sewing together the surrounding materials of adjacent pocket springs 708.

Other connection methods that allow each spring to move individually may be used as well. By individually wrapping each coil 712, a single pocket spring 708 can move independently of the other pocket springs 708 that make up the mattress 102. This allows better support of body mass and less movement of the rest of the mattress 102 when a person moves, sits, and/or stands on one section of the bed assembly 100. It is contemplated that in other examples other types of springs 708 can be used. For example, the springs 708 in other types of mattresses 102 can include Bonnell, offset, and/or continuous coils.

Also shown in FIG. 7, a mattress covering 720, such as a ticking fabric, may surround the mattress 102, including surrounding the rails 302 and the comfort layer 108. The mattress covering 720 may be made of a porous material that allows fluid communication between the ventilation openings 114 and the exterior of the mattress covering 720. The mattress covering 720 can provide a layer of protection for the mattress 102 that keeps the comfort layer 108 from becoming dirty or damaged, as well as providing additional comfort for a person sleeping on the mattress 102. Although, the mattress covering 720 is shown with the embodiment of the bed assembly 100 that includes a mattress 102 with pocket springs 708, the mattress covering 720 may also be used with any other embodiment of the bed assembly 100.

Figure 8:
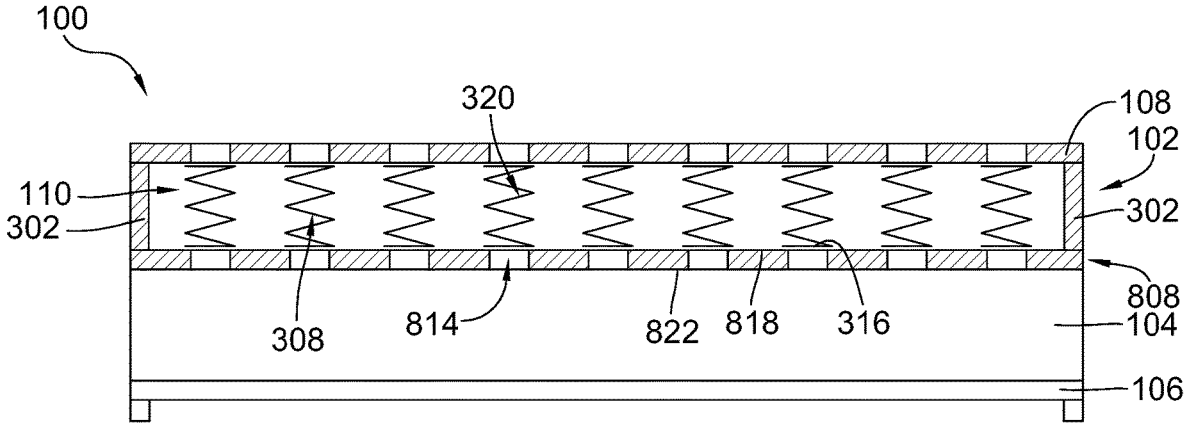
FIG. 8 is a cross-sectional side view of an alternative embodiment of the bed assembly of FIG. 1 with a support layer.
Figure 9:
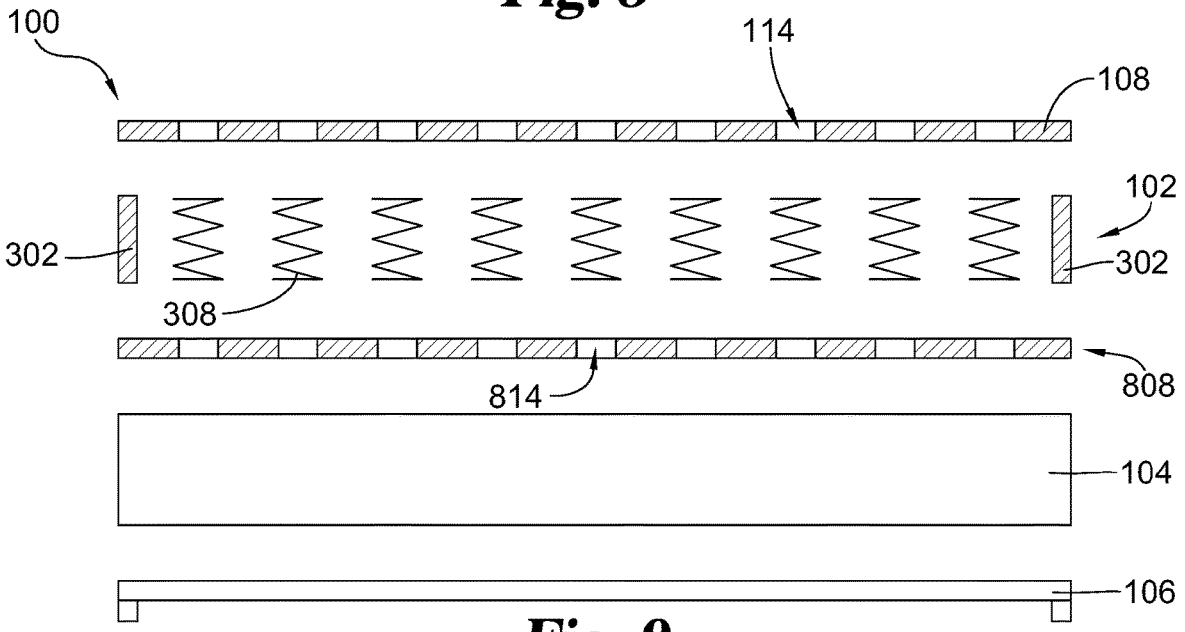
FIG. 9 is an exploded cross-sectional side view of the bed assembly of FIG. 7.

An alternative embodiment of the mattress 102 is shown in FIG. 8 and FIG. 9. The mattress 102 includes the ventilated comfort layer 108 as well as a ventilated support layer 808. The rails 302 of the mattress 102 extend between the comfort layer 108 and the support layer 808. Support layer ventilation openings 814 are defined through the support layer 808 and are in fluid communication with inner core 110, allowing air to flow into and out of the inner core 110 of the mattress 102 through the ventilation openings 814. The combination of the comfort layer 108 and the support layer 808 allows air to enter and exit inner core 110 from either side of the mattress 102 either through the ventilation openings 114 in the comfort layer 108 or through the ventilation openings 814 in the support layer 808.

The support layer 808 includes a support layer sleeping surface 818 and a support layer support surface 822. The support layer sleeping surface 818 is in contact with the spring support surface 316. Each of the ventilation openings 814 is aligned with respect to a corresponding spring 308 so that the ventilation openings 814 open into the coil opening 320 defined through a corresponding spring 308. Therefore, the ventilation openings 814 are also aligned with the ventilation openings 114 in the comfort layer 108.

Figure 10:
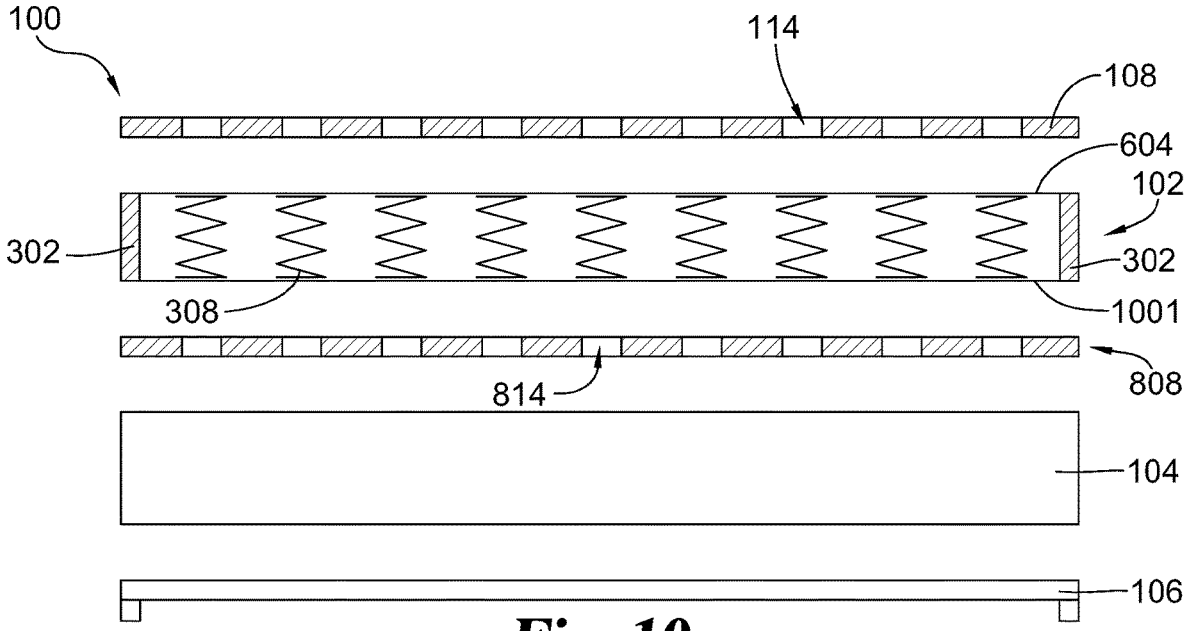
FIG. 10 is an exploded cross-section side view of an alternative embodiment of the bed assembly of FIG. 7.

In other embodiments, as shown in FIG. 10, the mattress 102 may include a mattress support surface 1001 that is separate from the support layer 808 and covers the springs 308. The mattress support surface 1001 may include its own ventilation openings that correspond to the ventilation openings 814 extending through the support layer 808, or the mattress support surface 1001 may be mesh or some other material that allows fluid communication between the inner core 110 of the mattress 102 and the ventilation openings 814.

Figure 11:
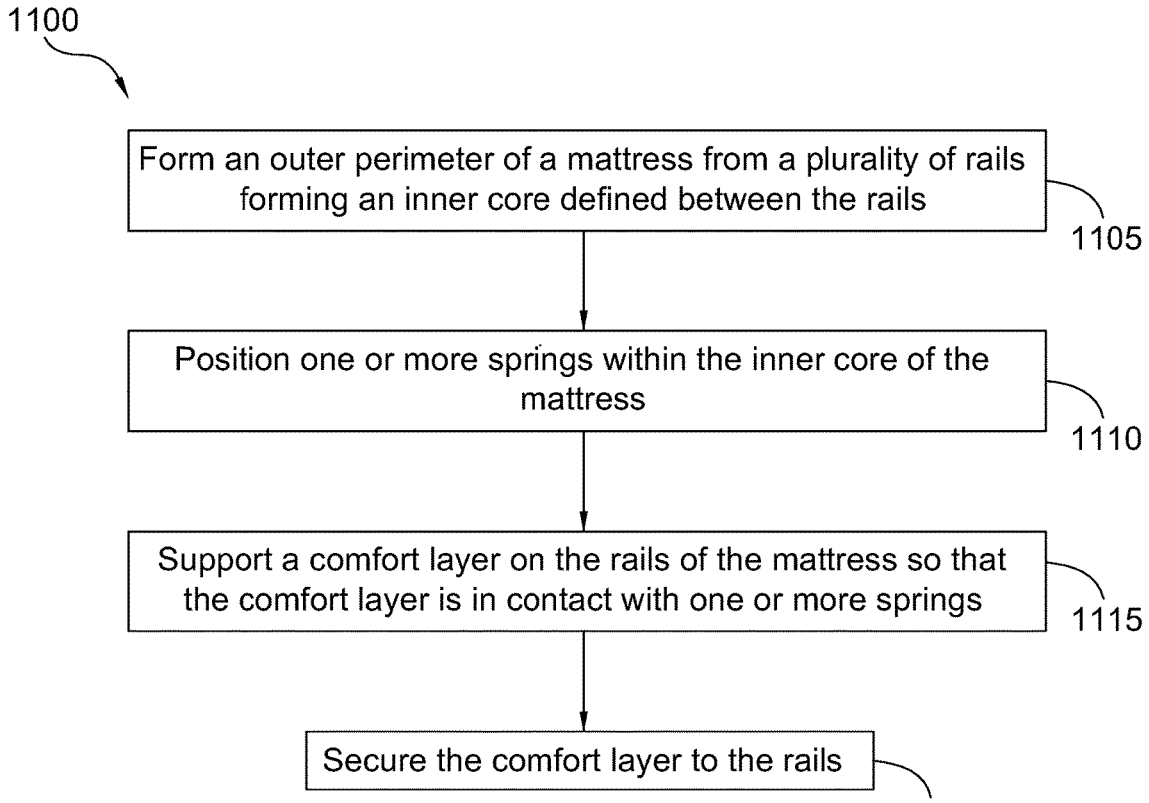
FIG. 11 is a flowchart for a method for securing a ventilated comfort layer to a mattress.

A method for securing a ventilated comfort layer to a mattress is illustrated in flowchart 1100 in FIG. 11. In a first stage 1105, an outer perimeter of a mattress is formed from a plurality of rails 302. An inner core 110 is defined between the rails 302. In a second stage 1110, one or more springs 308 are positioned within the inner core 110. Each of the springs 308 includes a coil 310 and a coil opening 320 defined through the coil 310.

In a third stage 1115, a comfort layer 108 including ventilation openings 114 is supported on the rails 302 of the mattress 102. The comfort layer 108 may be supported by the rails 302 so that springs 308 within the inner core 110 of the mattress 102 are in contact with the comfort layer 108. The ventilation openings 114 are in fluid communication with the inner core 110. In a fourth stage 1120, the comfort layer 108 is secured to the mattress 102, by either permanently attaching the comfort layer 108 using stitching or another suitable method or by removably attaching the comfort layer 108, for example using a system of straps.

In some embodiments, the comfort layer 108 is positioned on the rails 302 so that the ventilation openings 114 are aligned with the springs 308 so that at least one ventilation opening 114 is aligned with the coil opening 320 of each of the springs 308. This arrangement allows fluid communication between the ventilation opening 114 and the coil opening 320.

It should be understood that the stages in the flowchart 1100 may be performed in varying order in other embodiments. As an example, in some embodiments, the comfort layer may be positioned so that the ventilation openings 114 are aligned with the springs 308 before the comfort layer is supported by the rails of the mattress. Any other desired order of the stages that allows proper securement of the comfort layer to the mattress may also be used.

Glossary of Definitions and Alternatives

The language used in the claims and specification is to only have its plain and ordinary meaning, except as explicitly defined below. The words in these definitions are to only have their plain and ordinary meaning. Such plain and ordinary meaning is inclusive of all consistent dictionary definitions from the most recently published Webster's and Random House dictionaries. As used in the specification and claims, the following definitions apply to the following terms or common variations thereof (e.g., singular/plural forms, past/present tenses, etc.):

"Foam" generally refers to any substance formed by trapping pockets of gas in a solid and suitable for forming a surface on which a person can sleep. Foam may be made from a single material or a mix of materials. As an example, foam may refer to polyurethane, latex, polyurethane mixed with other materials such as gel beads, or any other suitable material.

"Mattress" generally refers to a large pad or fabric case filled with deformable or resilient material for supporting the reclining body, used as or on a bed for sleeping. Typically, but not always, the mattress may include a quilted or similarly fastened case, usually of heavy cloth, that contains cotton or foam rubber; a framework or inner core of metal springs; or the mattress may be inflatable.

"Memory foam" generally refers to any foam material that has increased viscosity and density, allowing the foam to conform to the shape of on object placed on the foam and to recover to an original shape after the object is no longer supported.

"Metal" generally refers to any malleable, fusible, ductile material that is a good conductor of electricity and heat. Metals are typically shiny in appearance and can refer to substances comprising a single element and also includes metal alloys formed by mixing several elements. Representative examples of metals include silver, copper, lead, aluminum, steel, and iron.

"Polyurethane" generally refers to any synthetic material in which polymer units are linked by carbamate or urethane groups. Polyurethane may exist in several different forms, such as a liquid, solid, or as a foam.

"Spring" generally refers to a resilient device, typically (but not always) a helical metal coil, that can be pressed or pulled but returns to its former shape when released. By way of nonlimiting examples, the springs can include various coil springs, pocket springs, Bonnell coils, offset coils, and/or continuous coils, to name just a few. As used herein, when springs are referred as being the "same" or "identical," it means that the springs are identified as being interchangeable parts (i.e., same part number) and/or share common physical characteristics, such as stiffness, gauge, coil type, shape, size, and weight, within normal engineering tolerances.

"Substantially" generally refers to the degree by which a quantitative representation may vary from a stated reference without resulting in an essential change of the basic function of the subject matter at issue. The term "substantially" is utilized herein to represent the inherent degree of uncertainty that may be attributed to any quantitative comparison, value, measurement, and/or other representation.

"Ventilation openings" generally refers to any portion of an object that allows the introduction of an external fluid into and/or out of a contained space. A ventilation opening may extend through the entirety of a surface of the object that surrounds the confined space to allow direct fluid communication with the confined space. A ventilation opening may also extend through only a portion of the object and allow fluid communication through a separate material that surrounds the ventilation opening, such as a mesh or other suitable porous material.

It should be noted that the singular forms "a", "an", "the", and the like as used in the description and/or the claims include the plural forms unless expressly discussed otherwise. For example, if the specification and/or claims refer to "a device" or "the device", it includes one or more of such devices.

It should be noted that directional terms, such as "up", "down", "top" "bottom", "fore", "aft", "lateral", "longitudinal", "radial", "circumferential", etc., are used herein solely for the convenience of the reader in order to aid in the reader's understanding of the illustrated embodiments, and it is not the intent that the use of these directional terms in any manner limit the described, illustrated, and/or claimed features to a specific direction and/or orientation.

While the invention has been illustrated and described in detail in the drawings and foregoing description, the same is to be considered as illustrative and not restrictive in character, it being understood that only the preferred embodiment has been shown and described and that all changes, equivalents, and modifications that come within the spirit of the inventions defined by following claims are desired to be protected. All publications, patents, and patent applications cited in this specification are herein incorporated by reference as if each individual publication, patent, or patent application were specifically and individually indicated to be incorporated by reference and set forth in its entirety herein.

I claim:

1. A sleep system, comprising:

a mattress, including:

one or more rails that form an outer perimeter of the mattress;

an inner core defined between the one or more rails;

one or more springs positioned within the inner core of the mattress, wherein each of the one or more springs includes a coil and a coil opening extending through the coil of the spring;

a comfort layer including a thickness extending between a comfort layer sleeping surface and a comfort layer support surface, wherein the comfort layer includes one or more comfort layer ventilation openings defined through the entire thickness of the comfort layer;

wherein the comfort layer is supported by the springs positioned within the inner core, and wherein the ventilation openings are in fluid communication with the inner core of the mattress;

wherein the outer perimeter of the mattress is one continuous solid surface;

a support layer including one or more support layer ventilation openings defined through the support layer;

wherein the comfort layer ventilation openings are positioned so that comfort layer ventilation openings are aligned with the support layer ventilation openings; and wherein the comfort layer ventilation openings and support layer ventilation openings have a one to one correspondence.

* * * * *